US012397890B1

(12) United States Patent
Anderson et al.

(10) Patent No.: US 12,397,890 B1
(45) Date of Patent: Aug. 26, 2025

(54) SYSTEMS AND METHODS FOR CONTROLLING TRIMMABLE MARINE DEVICES TO PREVENT OBJECT IMPACT

(71) Applicant: Brunswick Corporation, Mettawa, IL (US)

(72) Inventors: Glenn E. Anderson, Merritt Island, FL (US); Brad E. Taylor, Stillwater, OK (US)

(73) Assignee: Brunswick Corporation, Mettawa, IL (US)

( * ) Notice: Subject to any disclaimer, the term of this patent is extended or adjusted under 35 U.S.C. 154(b) by 241 days.

(21) Appl. No.: 17/748,684

(22) Filed: May 19, 2022

(51) Int. Cl.
*B63H 20/10* (2006.01)
*B63B 79/10* (2020.01)
*B63B 79/40* (2020.01)

(52) U.S. Cl.
CPC ..... *B63H 20/10* (2013.01); *B63B 79/10* (2020.01); *B63B 79/40* (2020.01); *B63B 2201/26* (2013.01)

(58) Field of Classification Search
CPC ..... B63H 20/10; B63H 20/08; B63H 20/106; B63H 5/125; B63H 20/22; B63H 2021/216; B63B 79/10; B63B 79/40; B63B 43/18
See application file for complete search history.

(56) References Cited

U.S. PATENT DOCUMENTS 5,238,432 A * 8/1993 Renner ..... B63H 20/106 440/56
5,741,165 A * 4/1998 Saito ..... F02B 75/16 248/641
6,183,321 B1 2/2001 Alby et al.
7,335,071 B1 * 2/2008 Motsenbocker ..... B63H 23/30 440/71
7,416,456 B1 8/2008 Gonring et al.
9,290,252 B1 3/2016 Tuchscherer et al.
9,694,892 B1 7/2017 Anschuetz et al.
9,751,605 B1 9/2017 Anschuetz et al.
9,919,781 B1 3/2018 Andrasko et al.
10,000,267 B1 6/2018 Anschuetz
10,059,415 B1 8/2018 Anschuetz et al.
10,351,221 B1 7/2019 Anschuetz et al.
(Continued)

FOREIGN PATENT DOCUMENTS

JP 2019172098 A * 10/2019 ..... B63H 20/20
WO WO-0047465 A1 * 8/2000 ..... B63B 43/18

*Primary Examiner* — Khoi H Tran
*Assistant Examiner* — Tanner L Cullen
(74) *Attorney, Agent, or Firm* — Andrus Intellectual Property Law, LLP

(57) ABSTRACT

A system configured for controlling a trim position of a trimmable drive unit with respect to a marine vessel. The system includes a trim actuator coupled to the trimmable drive unit and configured to rotate the trimmable drive unit about a horizontal trim axis, at least one obstruction sensor configured to sense obstructions proximate the trimmable drive unit, and a controller operably coupled to the trim actuator and the at least one obstruction sensor. The controller is configured to operate the trim actuator to rotate the trimmable drive unit about the horizontal trim axis, receive a signal from the at least one obstruction sensor indicating an obstruction within a predetermined threshold distance of the trimmable drive unit, and perform a mitigation operation to prevent the trimmable drive unit from impacting the obstruction.

21 Claims, 8 Drawing Sheets

(56) References Cited

U.S. PATENT DOCUMENTS

| | | | | |
|---|---|---|---|---|
| 11,262,767 | B2 | 3/2022 | Kamnick et al. | |
| 2012/0028517 | A1* | 2/2012 | Mochizuki | B63H 20/04 440/53 |
| 2012/0077395 | A1* | 3/2012 | Ooishi | B63H 20/08 440/65 |
| 2017/0158297 | A1* | 6/2017 | Sampson | B63H 20/10 |
| 2017/0323154 | A1* | 11/2017 | Kollmann | G06V 20/59 |

* cited by examiner

SYSTEMS AND METHODS FOR CONTROLLING TRIMMABLE MARINE DEVICES TO PREVENT OBJECT IMPACT

FIELD

The present disclosure generally relates to controlling trim position of a trimmable device coupled to a transom of a marine vessel, and more particularly to methods and systems for detecting objects in the area of the transom and preventing impact of the objects by the trimmable device.

BACKGROUND

The following U.S. Patents provide background information and are incorporated herein by reference, in entirety:

U.S. Pat. No. 6,183,321 discloses an outboard motor that comprises a pedestal that is attached to a transom of a boat, a motor support platform that is attached to the outboard motor, and a steering mechanism that is attached to both the pedestal and the motor support platform. It comprises a hydraulic tilting mechanism that is attached to the motor support platform and to the outboard motor. The outboard motor is rotatable about a tilt axis relative to both the pedestal and the motor support platform. A hydraulic pump is connected in fluid communication with the hydraulic tilting mechanism to provide pressurized fluid to cause the outboard motor to rotate about its tilting axis. An electric motor is connected in torque transmitting relation with the hydraulic pump. Both the electric motor and the hydraulic pump are disposed within the steering mechanism.

U.S. Pat. No. 7,416,456 discloses an automatic trim control system that changes the trim angle of a marine propulsion device as a function of the speed of the marine vessel relative to the water in which it is operated. The changing of the trim angle occurs between first and second speed magnitudes which operate as minimum and maximum speed thresholds.

U.S. Pat. No. 9,290,252 discloses systems and methods for controlling trim position of a marine propulsion device on a marine vessel. The system comprises a trim actuator having a first end that is configured to couple to the marine propulsion device and a second end that is configured to couple to the marine vessel. The trim actuator is movable between an extended position wherein the marine propulsion device is trimmed up with respect to the marine vessel and a retracted position wherein the marine propulsion device is trimmed down with respect to the marine vessel. Increasing an amount of voltage to an electromagnet increases the shear strength of a magnetic fluid in the trim actuator thereby restricting movement of the trim actuator into and out of the extended and retracted positions and wherein decreasing the amount of voltage to the electromagnet decreases the shear strength of the magnetic fluid thereby facilitates movement of the trim actuator into and out of the extended and retracted positions. A controller is configured to adapt the amount of voltage to the electromagnet based upon at least one condition of the system.

U.S. Pat. No. 9,694,892 discloses systems and methods for controlling a trim system on a marine vessel that includes receiving an actual trim position of a trimmable marine device at a controller and determining a magnitude of a trim position error by comparing the actual trim position to a target trim position with the controller. The method also includes determining a magnitude of an acceleration rate of the marine vessel. The controller determines the activation time of a trim actuator coupled to and rotating the marine device with respect to the marine vessel based on the magnitude of the trim position error and the magnitude of the acceleration rate. The controller then sends a control signal to activate the trim actuator to rotate the marine device toward the target trim position. The method includes discontinuing the control signal once the activation time expires to deactivate the trim actuator.

U.S. Pat. No. 9,751,605 discloses systems and methods for controlling a trim system on a marine vessel that includes receiving an actual trim position of a trimmable marine device at a controller and determining a trim position error by comparing the actual trim position to a target trim position with the controller. The method also includes determining an acceleration rate of the marine vessel. In response to determining that the trim position error exceeds a first error threshold and the magnitude of the acceleration rate exceeds a given rate threshold, the controller commands the marine device to the target trim position. In response to determining that the trim position error exceeds the first error threshold and the acceleration rate does not exceed the given rate threshold, the controller commands the marine device to a setpoint trim position that is different from the target trim position.

U.S. Pat. No. 9,919,781 discloses systems and methods to control position of a trimmable drive unit with respect to a marine vessel. A controller determines a target trim position as a function of vessel or engine speed. An actual trim position is measured and compared to the target trim position. The controller sends a control signal to a trim actuator to trim the drive unit toward the target trim position if the actual trim position is not equal to the target trim position and if at least one of the following is true: a defined dwell time has elapsed since a previous control signal was sent to the trim actuator to trim the drive unit; a given number of previous control signals has not been exceeded in an attempt to achieve the target trim position; and a difference between the target trim position and the actual trim position is outside of a given deadband.

U.S. Pat. No. 10,000,267 discloses a method for a trimmable marine device includes determining a target trim position of the marine device. A trim actuator is activated for an activation time that is calibrated to move the marine device from a current trim position to the target trim position. After activating the trim actuator for the calibrated activation time, a difference between an actual trim actuator condition and a desired trim actuator condition is calculated. An activation-time adapt value is determined based on the difference. The calibrated activation time is adjusted using the adapt value, and the trim actuator is activated for the adjusted activation time in response to subsequent changes in the target trim position. The adapt value is configured such that activating the trim actuator for the adjusted activation time moves the marine device closer to the target trim position than does activating the trim actuator for the calibrated activation time.

U.S. Pat. No. 10,059,415 discloses a system for controlling a tilt-trim position of a propulsion device on a marine vessel includes a user input device generating a command to rotate the propulsion device to a desired tilt-trim position, a position sensor sensing a current tilt-trim position of the propulsion device, a control module receiving the user command and the current tilt-trim position, and a tilt-trim actuator rotating the propulsion device. In response to determining that the propulsion device's engine is not running, the control module rotates the propulsion device until the desired tilt-trim position is achieved, and starts the engine in response to determining that the current tilt-trim position does not exceed a threshold. In response to determining that the engine is running, the control module determines whether a vessel and/or engine speed condition is met, and if so, rotates the propulsion device about the tilt-trim axis until the desired tilt-trim position is achieved.

U.S. Pat. No. 10,351,221 discloses a method for controlling a trim position of a marine propulsion device that includes receiving operator demands corresponding to propulsion system operating speeds and determining a rate of change of demand versus time between an initial and a subsequent operator demand. When the rate of change of demand exceeds a predetermined rate, the control module uses successively measured operating speeds of the propulsion system and an offset trim profile to determine setpoint trim positions for the propulsion device. As the propulsion system's measured operating speed increases from an initial to a subsequent operating speed, the control module controls a trim actuator to rotate the propulsion device to the setpoint trim positions. An operating speed at which the propulsion device begins trimming up is less according to the offset trim profile than according to a base trim profile, which is utilized when the rate of change does not exceed the predetermined rate.

U.S. Pat. No. 11,262,767 discloses a method of controlling tilt-trim position of a trimmable device on a marine vessel includes receiving an engine speed, a vessel speed, a vessel pitch, and/or a vessel acceleration. A trim rate is then determined based on the engine speed, the vessel speed, the vessel pitch, and/or the vessel acceleration. The trim rate specifies a rate of rotation of the trimmable device about a horizontal axis, and the trim rate is determined such that the rate of rotation is minimized at high vessel speeds and high engine speeds and the rate of rotation is maximized at low vessel speeds and low engine speeds. A variable speed trim actuator is then controlled to rotate the trimmable device based on the trim rate so as to adjust a trim position of the trimmable device.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one implementation of the present disclosure, a system configured for controlling a trim position of a trimmable drive unit with respect to a marine vessel is provided. The system includes a trim actuator coupled to the trimmable drive unit and configured to rotate the trimmable drive unit about a horizontal trim axis, at least one obstruction sensor configured to sense obstructions proximate the trimmable drive unit, and a controller operably coupled to the trim actuator and the at least one obstruction sensor. The controller is configured to operate the trim actuator to rotate the trimmable drive unit about the horizontal trim axis, receive a signal from the at least one obstruction sensor indicating an obstruction within a predetermined threshold distance of the trimmable drive unit, and perform a mitigation operation to prevent the trimmable drive unit from impacting the obstruction According to another implementation of the present disclosure, a method of controlling trim position of a trimmable drive unit on a marine vessel is provided. The method includes receiving a prompt to perform a trim check, receiving a signal from at least one obstruction sensor indicating an obstruction within a predetermined threshold distance of the trimmable drive unit, and responsive to a determination that a thrust is not commanded from the trimmable drive unit, performing a mitigation operation to prevent the trimmable drive unit from impacting the obstruction.

Various other features, objects, and advantages of the invention will be made apparent from the following description taken together with the drawings.

BRIEF DESCRIPTION OF THE DRAWINGS

The present disclosure is described with reference to the following Figures.

FIGS. 7A and 7B illustrate the operation of the trimmable drive unit of FIG. 5 in the presence of a movable walk-through.

DETAILED DESCRIPTION

Figure 1:
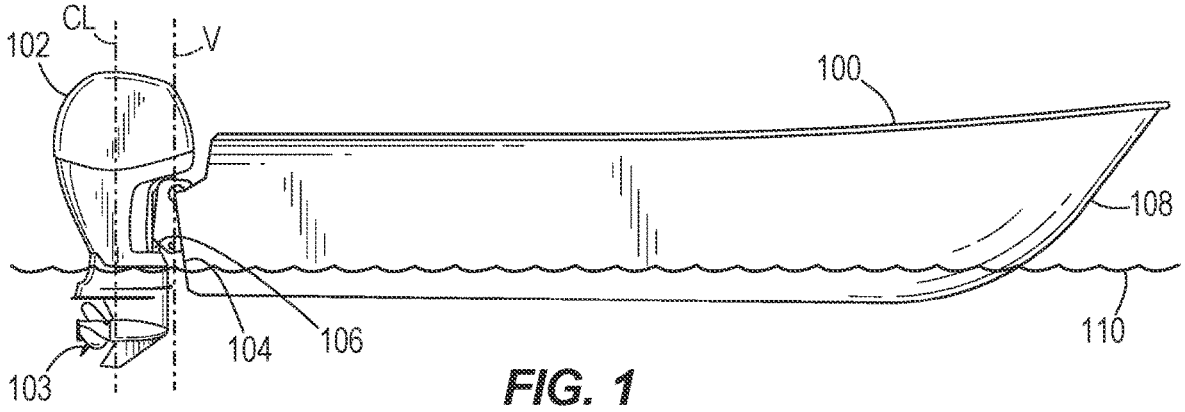
FIG. 1 illustrates a marine vessel having a trimmable drive unit in a neutral (level) trim position.

The present disclosure relates to systems and methods for controlling trim positions of one or more trimmable devices on a marine vessel. Examples of such trimmable devices include, but are not limited to, marine propulsion devices such as outboard motors. In certain examples described herein, the trimmable device is illustrated as an outboard motor, rotatable about a horizontal tilt-trim axis such that the propulsion device is moved with respect to a marine vessel to which it is coupled.

Designers are under increasing pressure from consumers to maximize both the features and usable space of marine vessels, and this pressure can result in problems when designers locate structural components in such a way that the trimmable device or devices are prevented from trimming into a full tilt or out of the water position due to the presence of the structural components. For example, components of the marine vessel that are temporarily or permanently located near the trimmable devices and at risk of impact by the trimmable devices may include, but are not limited to, walking paths, swim platforms, dive doors, sun pads, convertible seating, and water ski poles/pylons. The present inventors have thus recognized a need for systems and methods to prevent trimmable devices from impacting or contacting structural components of the marine vessel.

Existing systems to limit the trim of trimmable devices to prevent impacts have many associated drawbacks, including the complexity of such systems, the labor required for installation, and the lack of flexibility in responding to changing conditions on the marine vessel. According to one existing system, a logic box may be utilized to read a trim position sensor and interrupt a trim signal when the signal commands the trimmable device to exceed a certain trim angle. Similar existing systems may include a rotary switch that opens at a specific angle and interrupts an electrical signal to the trim system, and/or an engine control unit (ECU) that reads the trim position sensor and is calibrated to ignore certain trim requests from the helm or other trim input devices if they exceed a certain trim angle. However, reliance on a trim sensor position for operation of such systems can lead to confusing gauge readings. For example, when a manufacturer or operator implements a trim limit on the trimmable device, the trim sensor adapts to show a 0-100% operational trim range on the gauge, with 100% trim indicative of the trim limit position, rather than a full tilt position which an operator may wish to command. In addition, the trim limit may not be overridable by the operator, even in cases in which a trimmable device should be movable to a full tilt position to prevent damage to the vessel or injury to its occupants.

Other proposed methods of preventing impacts between trimmable devices and vessel components have similar drawbacks. Attaching sensors to each of the potentially obstructing components would result in an extremely complex system due to the need to wire each of the sensors in a parallel configuration. Likewise, incorporating actuators configured to automatically move obstructing structures (e.g., sunpads, walkways) out of the path of a trimmable device is unnecessarily complicated and expensive.

The disclosed methods and systems of the present invention therefore incorporate a sensing system on or into the cowling components of the trimmable drive units of the marine vessel such that an operator can 1) both command and achieve a desired trim when no obstructions are sensed in the path of a trimmable device, and 2) be alerted to the presence of an obstruction when a desired trim is not achievable. The present inventors have recognized that by integrating the sensing system into or in integral communication with the trimmable drive units, the simplest and most cost-effective sensing system is achieved without the attendant problems of the existing systems described above.

FIGS. 1-4 illustrate one example of a marine vessel 100 having a system 111 (see FIG. 8) for controlling trim of the marine vessel 100. The marine vessel 100 has a trimmable drive unit 102, such that the outboard motor shown herein, is coupled to the transom 104 of the marine vessel 100. The position of the drive unit 102 with respect to the transom 104 is controlled by a trim actuator 106.

Figure 2:
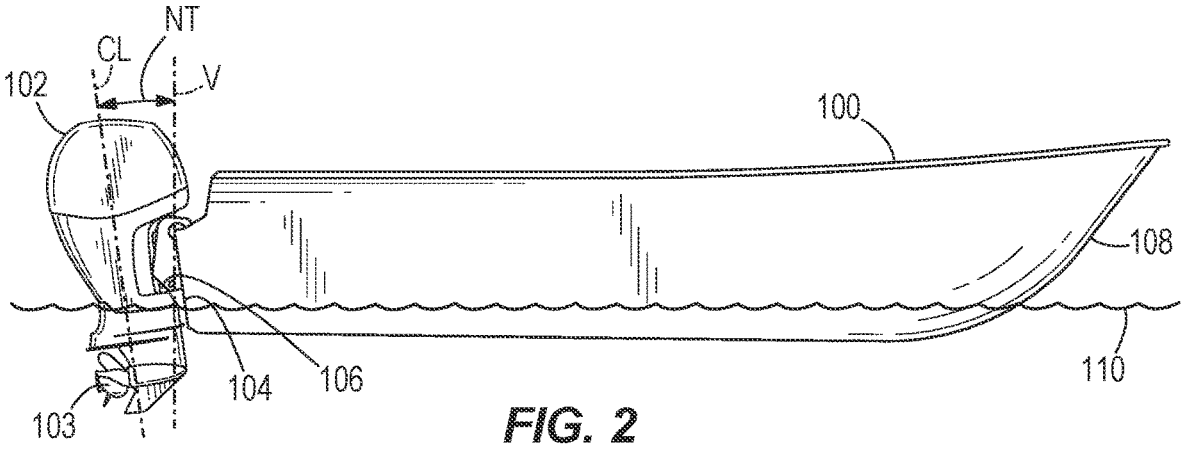
FIG. 2 illustrates the marine vessel of FIG. 1 with the trimmable drive unit in a trimmed in position.
Figure 3:
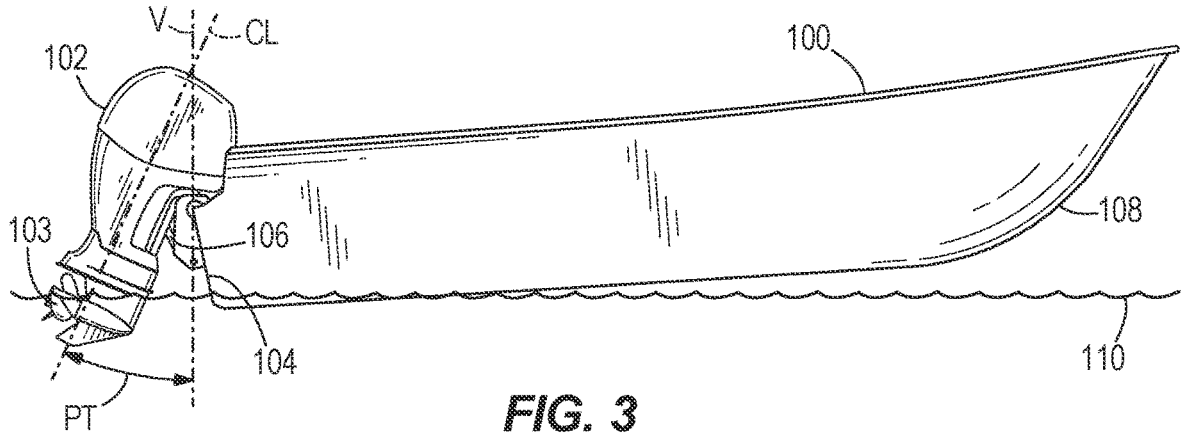
FIG. 3 illustrates the marine vessel of FIG. 1 with the trimmable drive unit in a trimmed out position.

In FIG. 1, the drive unit 102 is shown in a neutral (level) trim position, in which the drive unit 102 is in more or less of a vertical position. This can be seen by comparing centerline CL of the drive unit 102 with vertical line V, where the two lines are parallel. In FIG. 2, the drive unit 102 is shown in a trimmed in (trimmed down) position. In other words, the line CL and V will intersect below where the drive unit 102 is connected to the transom 104. This may be referred to as a negative trim angle (NT) according to an exemplary convention. In FIG. 3, the drive unit 102 is shown in a trimmed out (trimmed up) position. The lines CL and V will intersect above the drive unit's connection point to the transom 104. This may be referred to as a positive trim angle (PT). The position in FIGS. 1 and 2 are generally used when the marine vessel 100 is operating at slower speeds. For example, the trim position shown in FIG. 1 is often used when the marine vessel is in a joysticking mode or is docking. The trim position in FIG. 2 is often used during launch of the marine vessel 100, before the marine vessel has gotten up to speed and on plane. In contrast, the trim position shown in FIG. 3 is often used when the marine vessel is on plane and high speeds are required. At high speeds, the trim position shown in FIG. 3 causes the bow 108 of the marine vessel 100 to rise out of the water 110 as shown.

Figure 4:
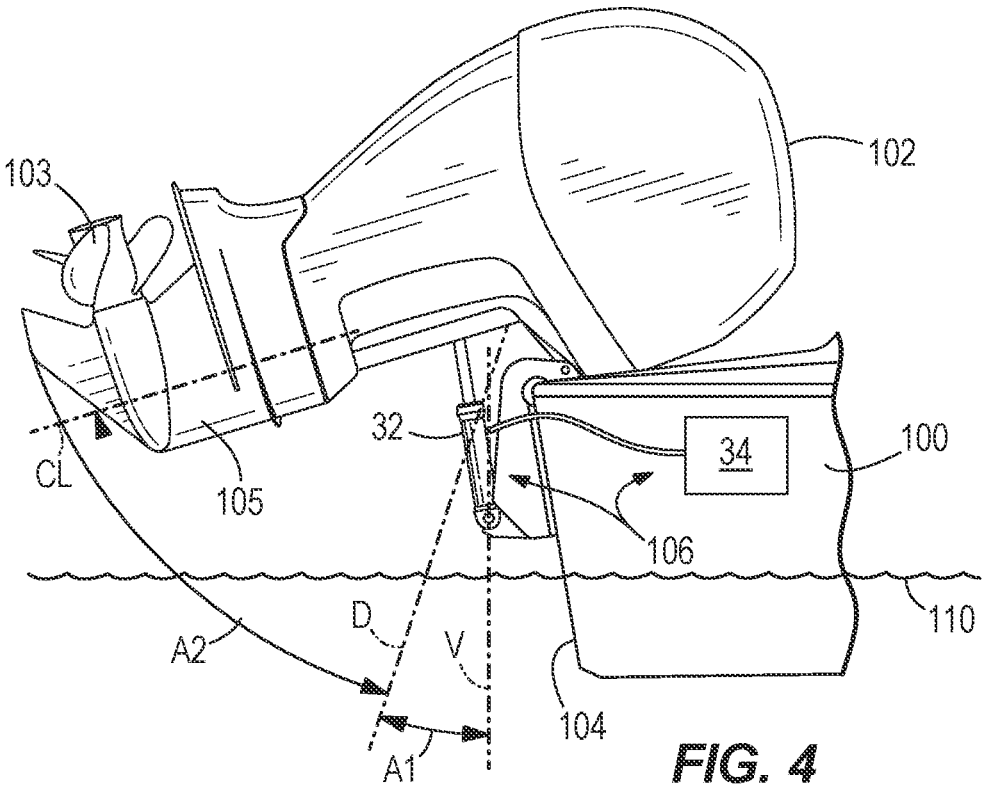
FIG. 4 illustrates the marine vessel of FIG. 1 with the trimmable drive unit in a full trim position.

As depicted in FIG. 4, the drive unit 102 may be trimmable to an angle A1, where the drive unit 102 is at an angle from vertical V that provides a functional depth of the propeller 103 in the water 110 for propelling the vessel 100. The drive unit 102 may alternatively be trimmed to an angle A1+A2, where the centerline CL is at an angle from vertical V that raises the propeller 103 out of the water 110 altogether. The line D thus represents a demarcation between a running trim range in which the propeller 103 is located in the water 110, and a trailer trim range in which the propeller 103 is lifted out of the water 110. A position in the trailer trim range of the drive unit 102 may be required for towing the marine vessel 100, shallow water beaching conditions, or for transportation by land. In some cases, the drive unit 102 may be fully trimmed up as shown in FIG. 4 when the marine vessel 100 is stationary in the water 110 and a convertible sun pad or swimming platform is deployed on the transom 104. In addition, the present inventors have further recognized that minimizing the amount of time that the propeller 103 and gearcase 105 spend submerged in the water 110, that is, within the running trim range A1, reduces corrosion and marine growth on the drive unit 102. Thus, the systems and methods of the present invention to ensure the drive unit 102 can be safely maneuvered into the trailer trim range A2 as depicted in FIG. 4 may increase the overall lifespan of the drive unit 102.

As is also depicted in FIG. 4, the trim actuator 106 may comprise a hydraulic piston-cylinder 32 connected to a hydraulic pump-motor combination 34. The piston-cylinder 32 has one end (here, the cylinder end) coupled to the transom 104 of the vessel 100 and the other end (here, the piston rod end) coupled to the drive unit 102. The piston-cylinder 32 operates to rotate the drive unit 102 to a trimmed-out position, to a trimmed-in position, or to maintain the drive unit 102 in any position therebetween as the pump-motor combination 34 provides hydraulic fluid to one side or the other of the piston to extend and retract the piston rod from the cylinder. In another example, the trim actuator 106 includes a brushless DC motor capable of rotating the trimmable device at continuously increasing or decreasing speeds. In still further examples, the trim actuator 106 may include an electric over hydraulic system, an electric linear actuator, a pneumatic actuator, or another type of device.

Figure 5:
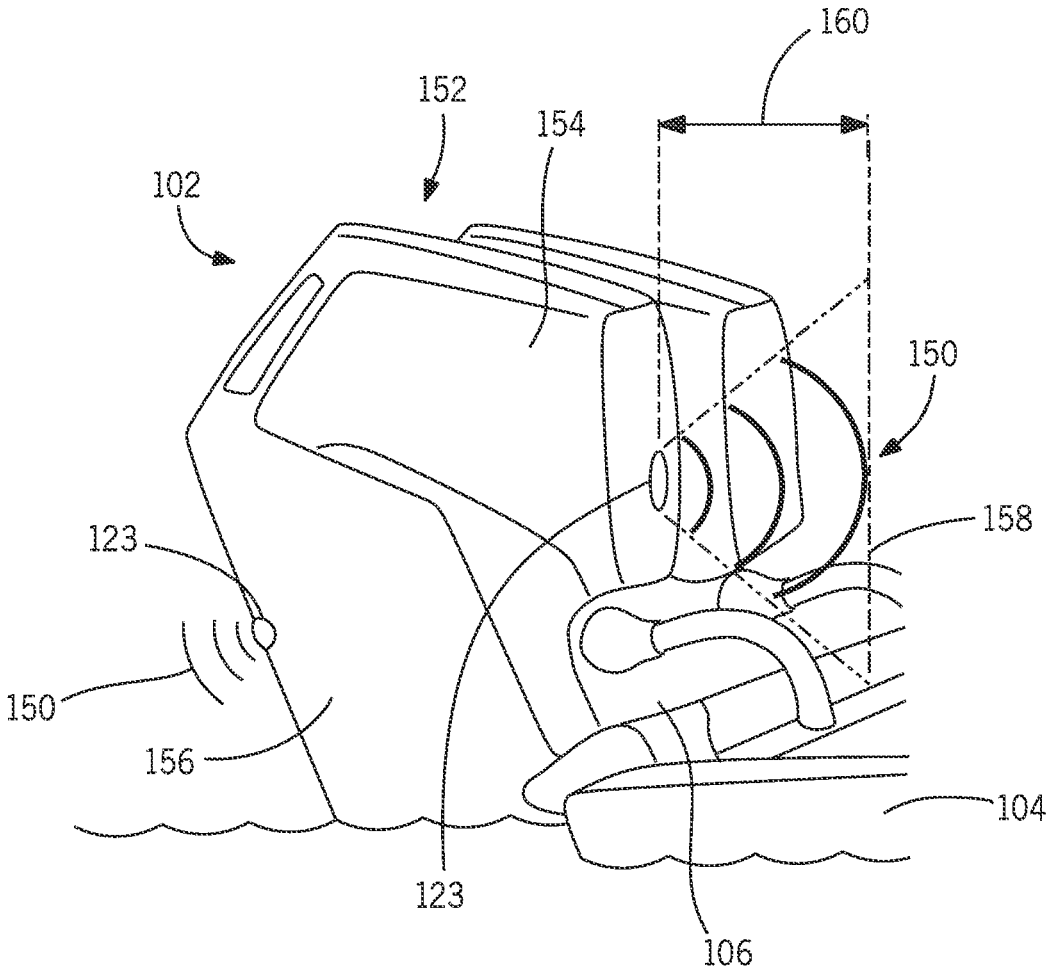
FIGS. 5 and 6 illustrate a marine vessel having a trimmable drive unit having an integrated obstruction sensor according to an exemplary embodiment of the present disclosure.
Figure 6:
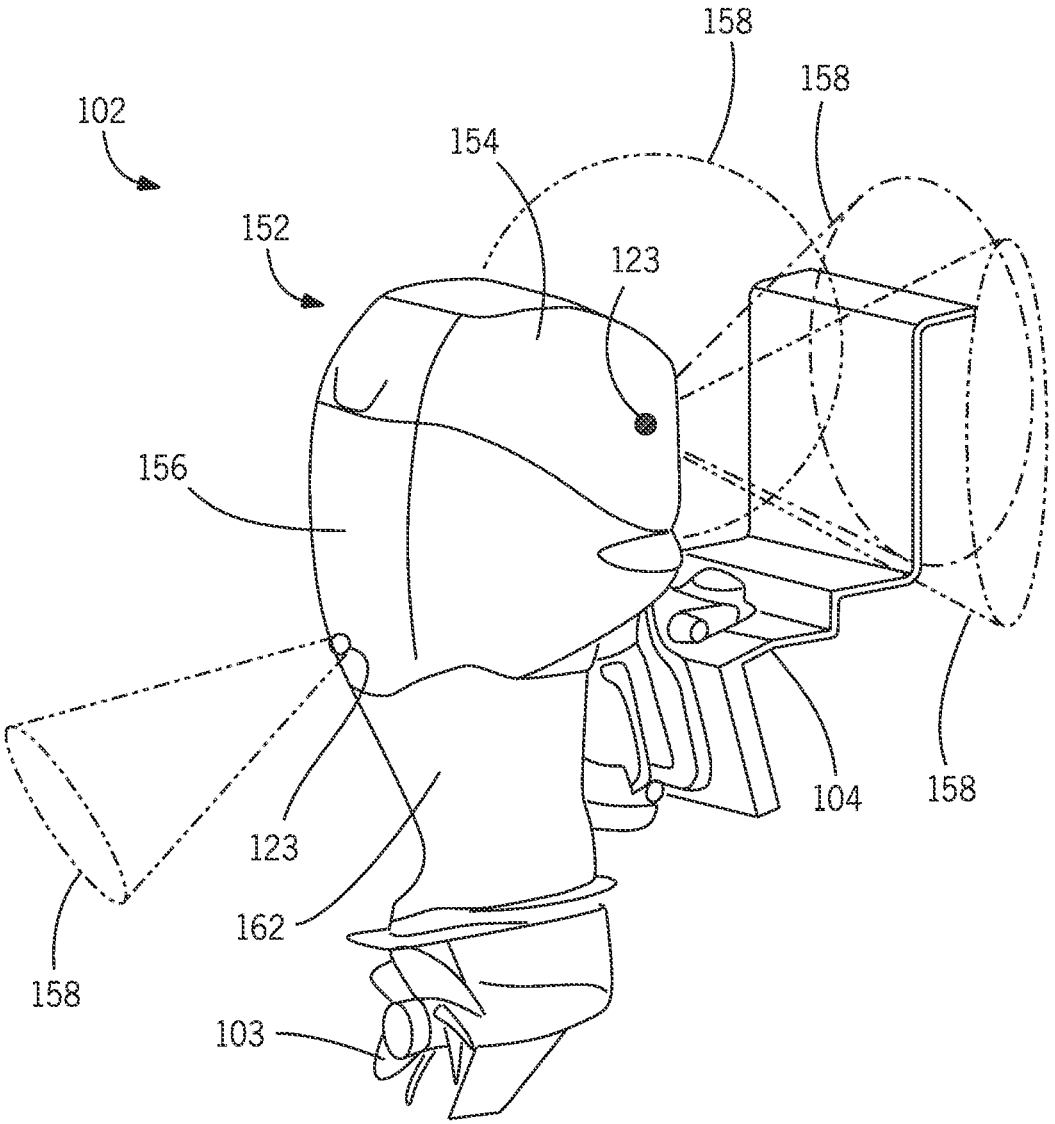

FIGS. 5 and 6 depict the obstruction sensing components (namely, obstruction sensors 123) of the trimmable drive unit 102 according to an exemplary embodiment of the present disclosure. As shown, the drive unit 102 may include a cowling system 152 to encapsulate and protect the internal components (e.g., internal combustion engine, electric motor) of the drive unit 102. In various embodiments, the cowling system 152 may comprise several cowling components, for example, an upper cowling component 154, a middle cowling component 156, and a lower cowling component 162 (see FIG. 6) that are coupled to each other.

One or more front-facing obstruction sensors 123 are shown to be integrated into the cowling system 152 and facing the transom 104. As described above, the present inventors have recognized that locating the obstruction sensors 123 on the trimmable drive unit 102, as opposed to the potentially obstructing objects on the marine vessel 100, results in a flexible and easily installable system that adapts to changing conditions on the marine vessel 100. In an exemplary implementation, the trimmable drive unit 102 further includes one or more obstruction sensors 123 integrated into the cowling system 152 and facing rearwardly (i.e., opposite the direction of the transom) and configured to detect objects located to the rear of the one or more trimmable drive units 102, for example, while the marine vessel 100 is backing into a slip. In addition, some swim platforms are configured to be mounted to the rear of the drive units 102 such that the trim range of the drive units 102 is significantly constrained when the swim platform is deployed. The rear-facing obstruction sensors 123 are shown to be positioned above the waterline 110, as the sensors 123 are not configured to sense obstructions located underwater.

The total number of obstruction sensors 123 and their mounting locations on the cowling system 152 are otherwise not particularly limited and may be dependent on a variety of characteristics unique to the marine vessel 100, for example, the number, size, and mounting locations of the drive units 102, the size and shape of the transom 104, and the potentially obstructing components on the vessel 100 and their positions. For example, as depicted in FIG. 6, a typical trimmable drive unit 102 may include three obstruction sensors 123 facing the transom 104, and one obstruction sensor 123 facing rearwardly opposite the transom 104. Each of the obstruction sensors 123 has an associated field of view 158. Typical values for the horizontal and vertical angles of the field of view 158 may range from 50°-65°, and a typical detection range 160 may range from 0.08 ft to 8 ft. In an exemplary embodiment, the obstruction sensors 123 are flush mounted with the cowling system 152 so as to not disrupt the sleek and attractive appearance of the cowling system 152.

The type of sensor implemented as the obstruction sensors 123 is also not particularly limited. In an exemplary embodiment, the one or more obstruction sensors 123 attached to or embedded in the cowling 152 of the trimmable drive unit 102 are infrared (IR) sensors. The IR sensors emit infrared light that is either interrupted or reflected back to the sensor upon encountering obstructions in the path of the light. Based upon the interruptions or reflections, the distance to an obstruction and an approach speed to the obstruction can be determined. In other embodiments, the one or more obstruction sensors 123 attached to or embedded in the cowling 152 of the trimmable drive unit 102 are ultrasonic sensors. Ultrasonic sensors emit high frequency sound pulses (e.g., depicted as pulses 150) and measure the frequency of pulses that are reflected upon encountering obstructions in the proximity of the sound pulses. Based on the difference in frequency between the emitted and reflected sound pulses, both the distance to an obstruction and an approach speed to the obstruction can be determined. In still further embodiments, the obstruction sensors 123 attached to or embedded in the cowling 152 of the trimmable drive unit 102 are electromagnetic sensors. Rather than emitting sound waves, electromagnetic sensors emit radio waves that are reflected back to the sensor upon encountering obstructions.]

Figure 7B:
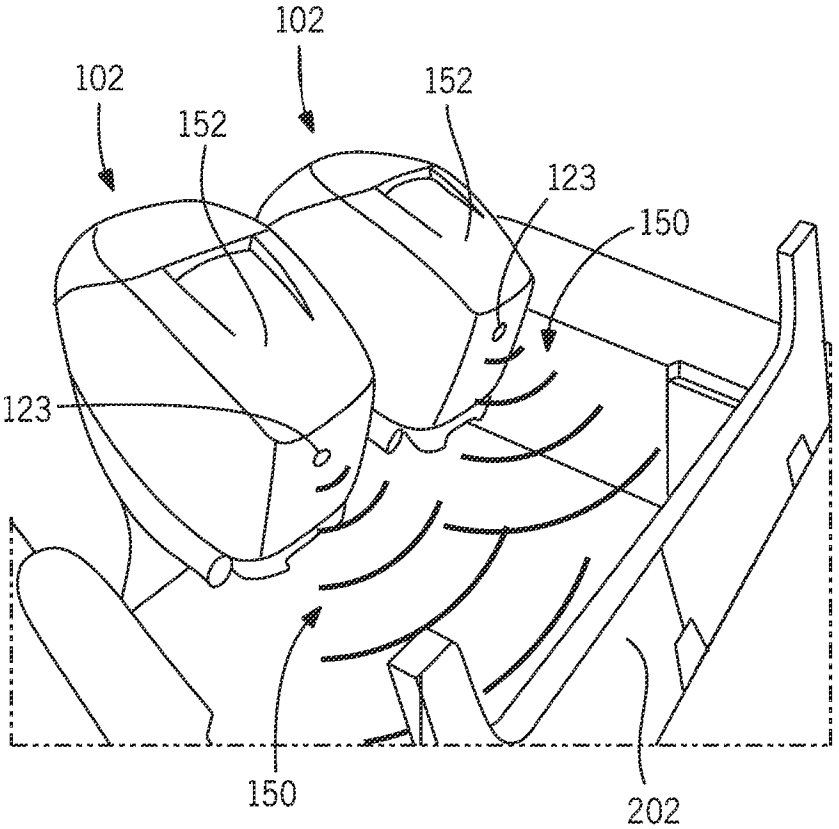
Figure 7A:
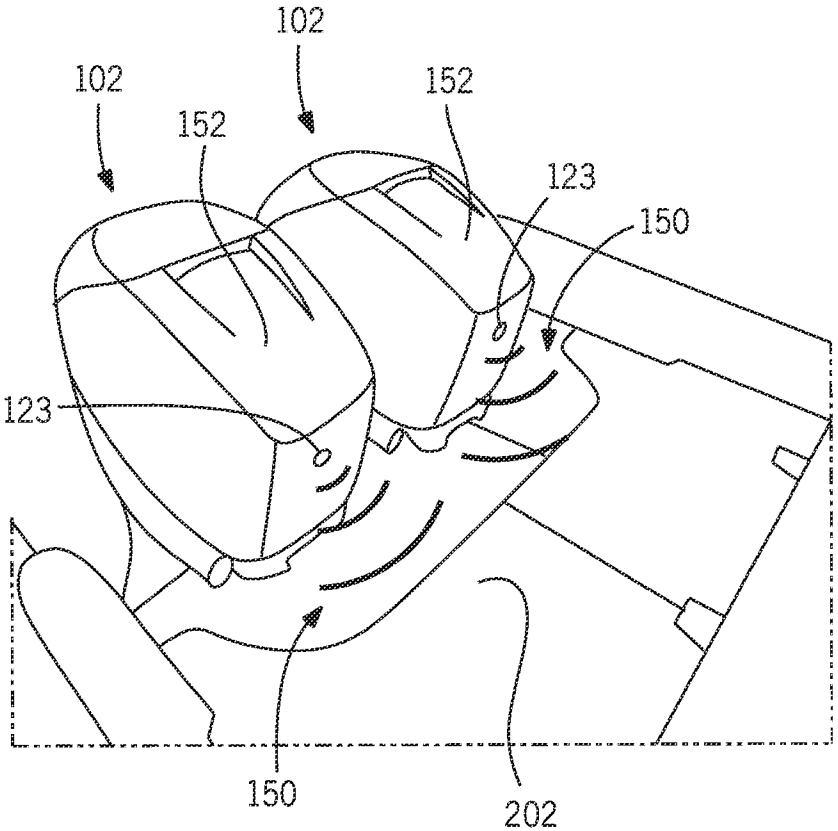

FIGS. 7A and 7B depict the operation of the transom-facing obstruction sensors 123 of the trimmable drive unit 102. Specifically, FIG. 7A depicts a walkthrough 200 in a deployed configuration. As trim actuators rotate the drive units 102 toward full trailer trim positions, upon detecting the presence of the walkthrough 200 within the predetermined distance or detection range 202 of the obstruction sensors 123, a controller or control unit (e.g., controller 116, see FIG. 8) will perform an impact mitigation action (e.g., command the trim actuator to stop trimming the drive units 102, command a user interface display device to display an alert message to an operator). Further examples of potential impact mitigation actions are described below with respect to FIGS. 9 and 10. Responsive to the impact mitigation action, an operator is prompted to remove or reposition the obstruction. For example, as depicted in FIG. 7B, an operator may manually pivot the walkthrough 200 upwardly to a non-obstructing position to provide sufficient clearance for the drive units 102 to continue trimming toward full tilt positions.

Figure 8:
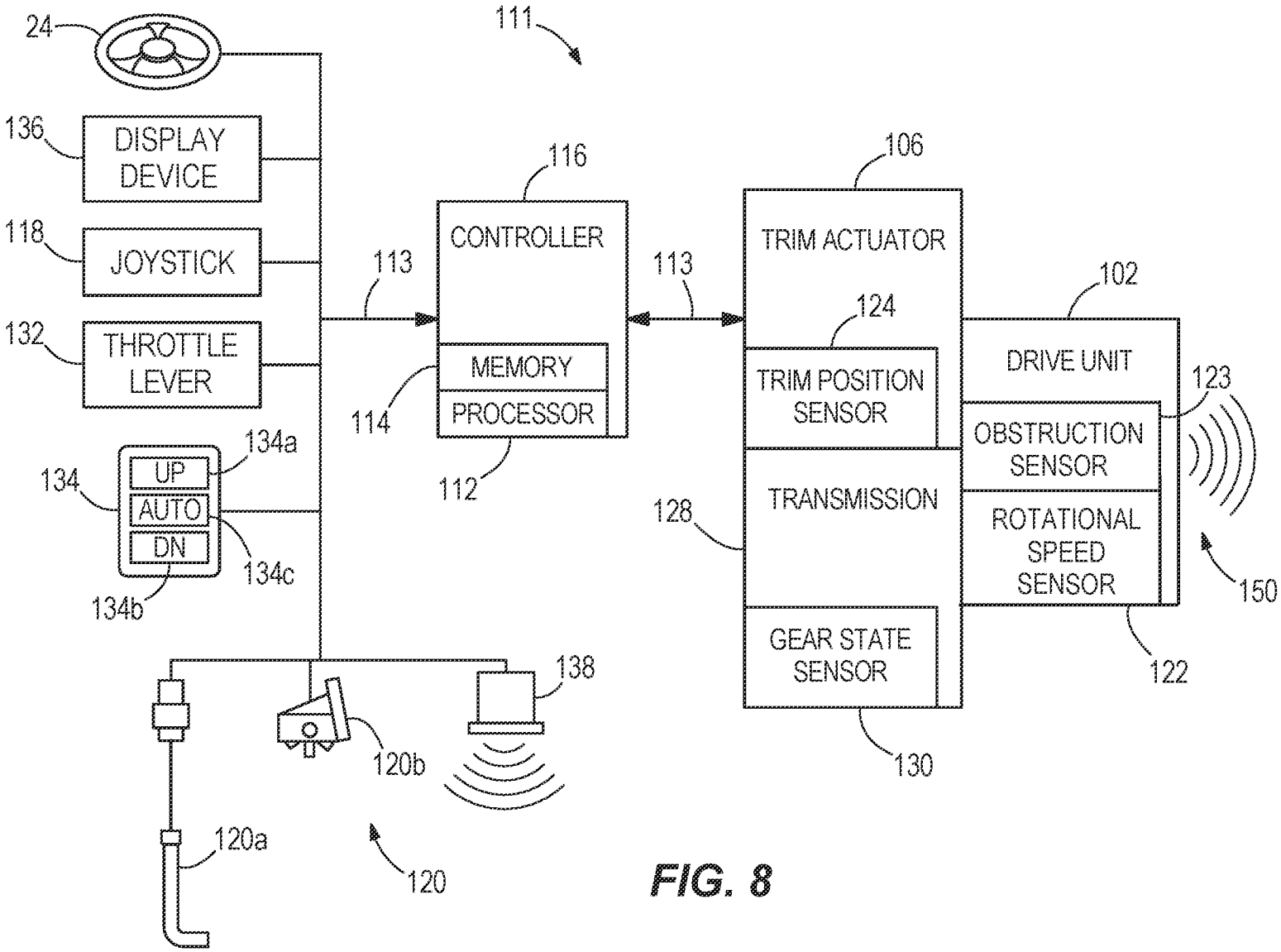
FIG. 8 illustrates a system for controlling the trimmable drive unit of FIG. 5.

Referring now to FIG. 8, a schematic of the system 111 associated with the marine vessel 100 of FIGS. 1-7B is depicted. In the example shown, the system 111 includes a controller 116 that is programmable and includes a processor 112 and a memory 114. The controller 116 can be located anywhere in the system 111 and/or located remote from the system 111 and can communicate with various components of the marine vessel 100 via wired and/or wireless links, as will be explained further herein below. Although FIG. 8 shows a single controller 116, the system 111 can include more than one controller 116. For example, the system 111 can have a controller 116 located at or near a helm of the marine vessel 100 and can also have one or more controllers located at or near the drive unit 102. Portions of the control method (e.g., method 900, see FIG. 9 below) can be carried out by a single controller or by several separate controllers. Each controller 116 can have one or more control sections or control units. One having ordinary skill in the art will recognize that the controller 116 can have many different forms and is not limited to the example that is shown and described. For example, here the controller 116 carries out the trim control method for the entire system 111 but in other examples, separate trim control units and propulsion control units could be provided.

In some examples, the controller 116 may include a computing system that includes a processing system, storage system, software, and input/out (I/O) interfaces for communicating with devices such as those shown in FIG. 8, and about to be described herein. The processing system loads and executes software from the storage system, such as software programmed with a trim control method. When executed by the computing system, trim control software directs the processing system to operate as described herein below in further detail to execute the trim control method. The computing system may include one or many application modules and one or more processors, which may be communicatively connected. The processing system can comprise a microprocessor (e.g., processor 112) and other circuitry that retrieves and executes software from the storage system. Processing system can be implemented within a single processing device but can also be distributed across multiple processing devices or sub-systems that cooperate in existing program instructions. Non-limiting examples of the processing system include general purpose central processing units, applications specific processors, and logic devices.

The storage system (e.g., memory 114) can comprise any storage media readable by the processing system and capable of storing software. The storage system can include volatile and non-volatile, removable and non-removable media implemented in any method or technology for storage of information, such as compute readable instructions, data structures, program modules, or other data. The storage system can further include additional elements, such as a controller capable of communicating with the processing system. Non-limiting examples of storage media include random access memory, read only memory, optical discs, flash memory, virtual memory and non-virtual memory, magnetic sets, magnetic tape, magnetic disc storage or other magnetic storage devices, or any other medium which can be used to store the desired information and that may be accessed by an instruction execution system. The storage media can be a non-transitory or a transitory storage media.

In this example, the controller 116 communicates with one or more components of the system 111 via a communication link 113, which can be a wired or wireless link. The controller 116 is capable of monitoring and controlling one or more operational characteristics of the system 111 and its various subsystems by sending and receiving control signals via the communication link 113. In one example, the communication link 113 is a controller area network (CAN) bus, but other types of links could be used. It should be noted that the extent of connections of the communication link 113 shown herein is for schematic purposes only, and the communication link 113 in fact provides communication between the controller 116 and each of the sensors, devices, and various subsystems described herein, although not every connection is shown in the drawing for purposes of clarity.

As mentioned, the controller 116 receives inputs from several different sensors (e.g., the obstruction sensor 123) and/or input devices aboard or coupled to the marine vessel. For example, the controller 116 receives a steering input from a joystick 118 and/or a steering wheel 24. The controller 116 is provided with an input from a vessel speed sensor 120. The vessel speed sensor 120 may be, for example, a pitot tube sensor 120 *a*, a paddle wheel type sensor 120 *b*, or any other speed sensor appropriate for sensing the actual speed of the marine vessel. The vessel speed may instead be obtained by taking readings from a GPS device, which calculates speed by determining how far the vessel has traveled in a given amount of time. The drive unit 102 is provided with an rotational speed sensor 122 such as but not limited to a tachometer that determines a speed of an internal combustion engine or electric motor that is powering the drive unit 102 in rotations per minute (RPM). A trim position sensor 124 is also provided for sensing an actual position of the trim actuator 106, for example, by measuring a relative position between two parts associated with the trim actuator 106. The trim position sensor 124 may be any type of sensor known to those having ordinary skill in the art, for example a Hall effect sensor or a potentiometer. A transmission 128 and gear state sensor 130 (sensing forward, neutral, or reverse gear of the transmissions) can also be provided for the drive unit 102. The gear state sensor 130 may be a potentiometer and electronic converter, such as an analog to digital converter that outputs a discrete analog to digital count that represents a position of a shift linkage associated with the transmission, or may be a potentiometer sensing a position of a throttle lever 132 as signifying a gear state of the transmission.

Other inputs can come from operator input devices such as the throttle lever 132, a keypad 134, and a display device 136, such as a touchscreen. The throttle lever 132 allows the operator of the marine vessel to choose to operate the vessel in neutral, forward, or reverse, as is known. The keypad 134 can be used to initiate or exit any number of control or operation modes, or to make selections while operating within one of the selected modes. In one example, the operator input device such as the keypad 134 comprises an interface having at least a "trim up" input 134 *a*, a "trim down" input 134 *b*, and an "auto-trim on/resume" input 134 *c*, shown herein as buttons. The controller 116 operates the system 111 in the manual mode in response to selection of one of the "trim up" 134 *a* and "trim down" inputs 134 *b*. For example, a trim up command will actuate the trim actuator 106 to trim the drive unit 102 up, while a trim down command will command the trim actuator 106 to trim the drive unit 102 down. On the other hand, the controller 116 may operate the system 111 in an automatic mode in response to selection of the "auto-trim on/resume" input 134 *c*. The display device 136 or other operator input device can also be used to initiate or exit any number of control or operation modes (such as trim up, trim down, or auto-trim mode), and in that case the inputs can be buttons in the traditional sense or selectable screen icons. The display device 136 can also display information about the system 111 to the operator of the vessel, such as engine speed, vessel speed, trim angle, trim operating mode, propulsion system operating mode, etc. In some implementations, the display device 136 may include an integrated audible alarm device, for example, to emit an alarm when the obstruction sensor 123 detects an obstruction proximate the drive unit 102. Further details of such an alarm are included below with reference to FIGS. 9 and 10. A water depth sensor 138 such as a sonar may also be provided.

Figure 9:
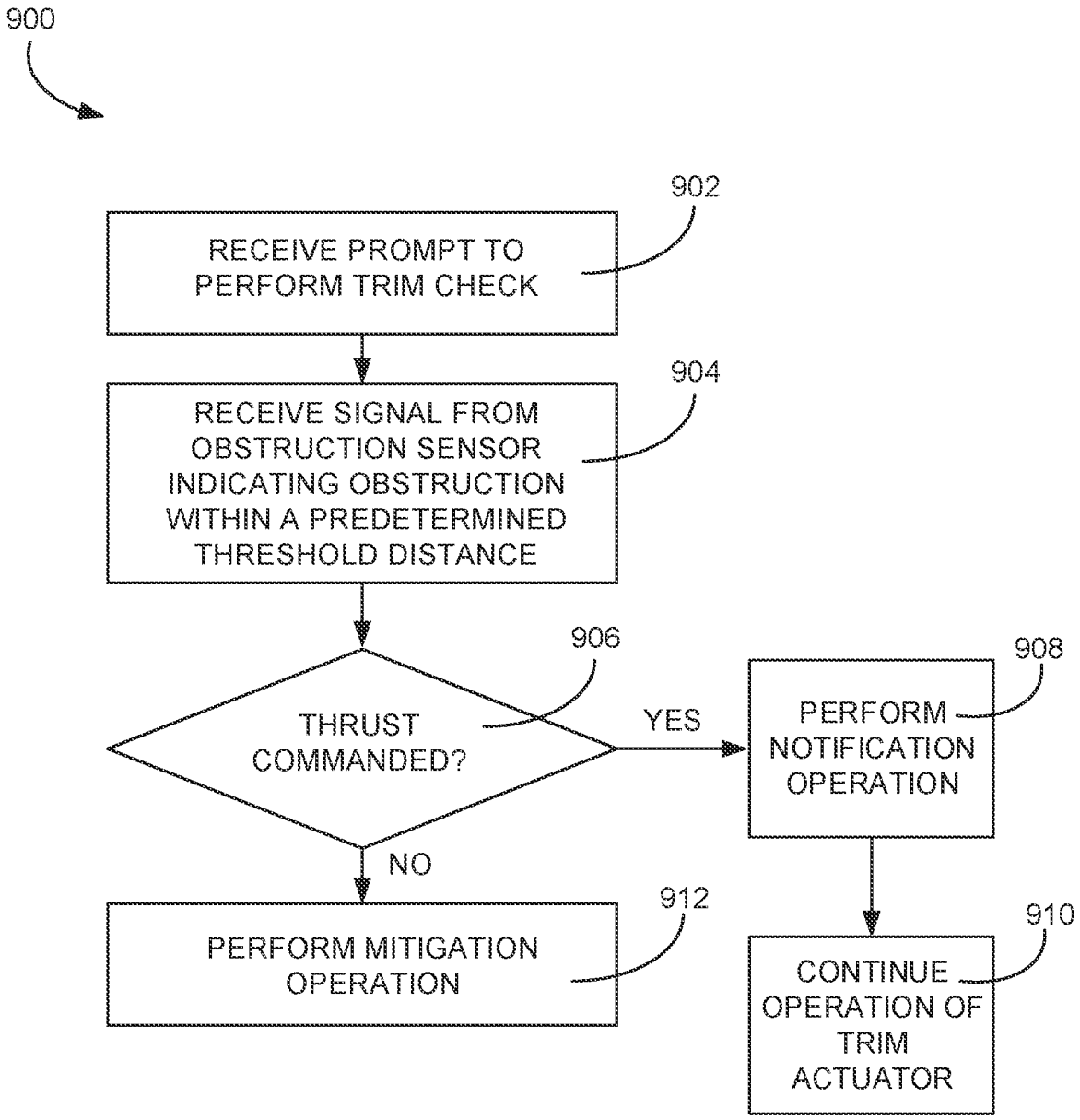
FIG. 9 illustrates a method for controlling the trimmable drive unit of FIG. 5 when the trimmable drive unit encounters an obstruction on the marine vessel.

Turning now to FIG. 9, a control method 900 for detecting and responding to an obstruction in the vicinity of the trimmable drive unit 102 is shown. In an exemplary embodiment, the control method of FIG. 9 may be carried out by the processor 112 executing instructions stored in the memory 114 of the controller 116. The control method 900 may utilized with any number of trimmable drive units 102 installed on the marine vessel 100, and may be performed for each drive unit 102 independently. For example, if the marine vessel 100 includes three trimmable drive units 102, and a water ski pole is positioned on the transom 104 such that it prevents only the trimmable drive unit 102 in the center position from trimming to a full trailer trim position, upon receiving a command from an operator to move all drives 102 to full trailer trim positions, control method 900 may command the trim actuators 106 to drive the outer drives 102 to the full trailer trim position while halting trim of the center drive 102. For the purposes of simplicity, method 900 will be described below exclusively with reference to a single trimmable drive unit 102.

Method 900 commences with step 902, in which the controller 116 receives a prompt to perform a trim check operation to determine whether the area surrounding the trimmable drive unit 102 is free from obstacles preventing trim of the drive unit 102. A variety of actions may initiate the trim check operation at step 902. In some embodiments, the trim check may be trigged by the operator initiating key up of the marine vessel 100. In other embodiments, the trim check may be triggered when the gear state sensor 130 indicates that the transmission 128 has been moved into forward or reverse gear. In still further embodiments, the trim check may be triggered by the operator requesting a change in trim via the keypad 134 or the system 111 entering an auto-trim operation mode.

At step 904, the controller 116 receives a signal from one or more of the obstruction sensors 123 embedded in the drive unit 102 indicating an obstruction within a predetermined threshold distance of the obstruction sensor 123 that may result in an impact between the drive unit 102 and the obstruction. As described above with reference to FIGS. 5 and 6, a typical threshold distance of the obstruction sensor 123 may range from 0.08 ft to 8 ft. In various embodiments, the controller 116 may ignore or may only be configured to receive a signal from one or more of the obstruction sensors 123 when the trim position sensor 124 indicates that the drive unit 102 is within a particular trim angle range. For example, if the trim position sensor 124 indicates that the drive unit 102 is at a trim angle such that the field of view 158 of a rear-facing obstruction sensor 123 is facing the water 110 rather than any potential obstructions to the rear of the drive unit 102, the controller 116 may ignore any signals received from the rear-facing obstruction sensor 123 until the trim position sensor 124 indicates that the drive unit 102 is within a trim angle range in which obstructions located behind the drive unit 102 are likely to be within the field of view 158 of the rear-facing obstruction sensor 123.

At step 906, the controller 116 determines whether the system 111 is commanding thrust from the drive unit 102. In an exemplary embodiment, this determination may be based on signals received from the rotational speed sensor 122 and/or the gear state sensor 130. If the system 111 is commanding thrust from the drive unit 102 at step 906, method 900 proceeds to step 908, in which the controller 116 performs an obstruction notification operation. The obstruction notification operation is intended to notify the operator of the presence of the obstruction without otherwise interfering in the operation of the trim actuator 106. For example, the obstruction notification operation may include visual and/or audible pending impact alarm or alert messages displayed to the operator on the display device 136. Method 900 then proceeds to step 910, in which the controller 116 continues to operate the trim actuator 106 as commanded by the operator or the auto-trim operation mode. The present inventors have recognized that when the marine vessel 100 is running, it may be critical to the safety of the marine vessel 100 to achieve the trim requested by an operator even in the presence of an obstruction.

If, however, the controller 116 determines that the system 111 is not commanding thrust from the drive unit 102 at step 906 and the marine vessel 100 is stationary, method 900 proceeds to step 912 in which the controller 116 performs an obstruction mitigation action in response to detection of the obstruction at step 904. The obstruction mitigation action may command the trim actuator 106 to stop trimming the drive unit 102 completely, or may command the trim actuator 106 to reduce the trim rate such that the approach of the drive unit to the obstruction is slowed. The obstruction mitigation action may further include actions similar to the obstruction notification action of step 908, namely, commanding the display device 136 to generate a visual and/or audible pending impact alarm or alert messages.

Figure 10:
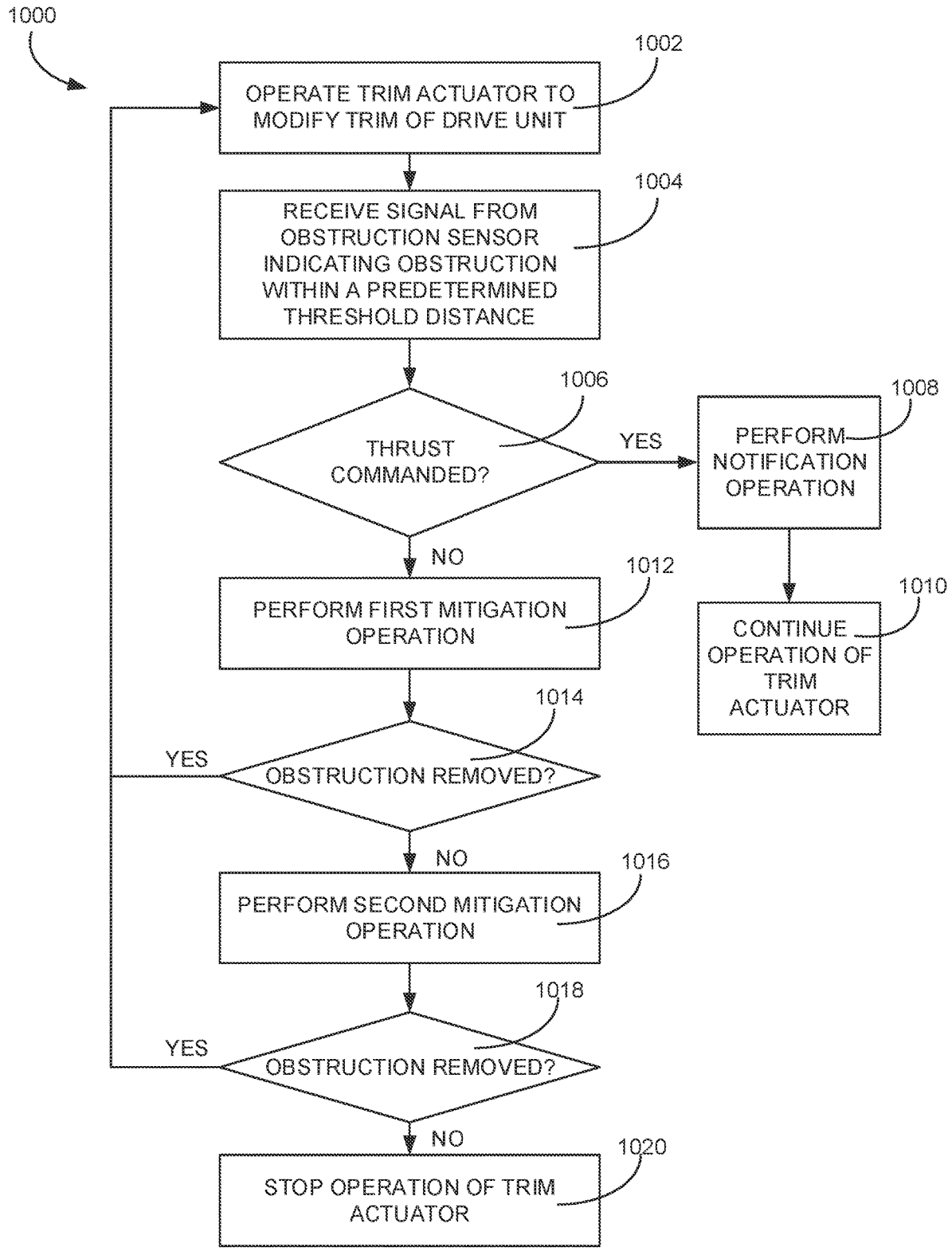
FIG. 10 illustrates another method for controlling the trimmable drive unit of FIG. 5 when the trimmable drive unit encounters an obstruction on the marine vessel.

Turning now to FIG. 10, another control method 1000 for detecting and responding to an obstruction in the vicinity of the trimmable drive unit 102 is shown. In an exemplary embodiment, the control method of FIG. 10 may be carried out by the processor 112 executing instructions stored in the memory 114 of the controller 116. As described above, although the control method 1000 may be independently implemented with respect to each of multiple drive units 102, for the purposes of simplicity, method 1000 will be described below exclusively with respect to one drive unit 102.

Method 1000 commences with step 1002, in which the controller 116 operates the trim actuator 106 to modify the trim of the trimmable drive unit 102 (see FIGS. 2-4). In an exemplary embodiment, the controller 116 may initiate operation of the trim actuator 106 responsive to operator commands received at the keypad 134 and/or the display device 136. At step 1004, the controller 116 receives a signal from the obstruction sensor 123 embedded in the drive unit 102 indicating an obstruction within a predetermined threshold distance of the obstruction sensor 123 that may result in an impact between the drive unit 102 and the obstruction.

At step 1006, the controller 116 determines whether the system 111 is commanding thrust from the drive unit 102. As described above with reference to FIG. 9, this determination may be based on signals received from the rotational speed sensor 122 and/or the gear state sensor 130. If the system 111 is commanding thrust from the drive unit 102 at step 1006, method 1000 proceeds to step 1008, in which the controller 116 performs an obstruction notification operation, which may include visual and/or audible pending impact alarm or alert messages displayed to the operator on the display device 136. Method 1000 then proceeds to step 1010, in which the controller 116 continues to operate the trim actuator 106 as commanded by the operator or the auto-trim operation mode.

If, however, the controller 116 determines that the system 111 is not commanding thrust from the drive unit 102 at step 1006 and the marine vessel is stationary, method 1000 continues with step 1012, in which the controller 116 performs a first impact mitigation operation to prevent the trimmable drive unit 102 from contacting the detected obstruction. In some embodiments, the first mitigation operation involves controlling the trim actuator 106. For example, the controller 116 may command the trim actuator 106 to stop trimming the drive unit 102 completely. In other implementations, the controller 116 may command the trim actuator 106 to reduce the trim rate such that the approach of the drive unit 102 to the obstruction is slowed.

The first mitigation operation may also include the generation of alerts or alarms to notify an operator of the obstruction. As described above, the display device 136 may be adapted to provide both visual and audible pending impact alarm or alert messages to an operator. Examples of such pending impact alarms include, but are not limited to, alert messages featuring text, alert messages featuring camera images depicting the obstruction, alert sounds featuring beeping or horn noises, and alert sounds featuring spoken warnings regarding the obstruction. In various embodiments, the first impact mitigation operation includes a combination of these actions: for example, upon receiving the signal indicating the obstruction, the controller 116 may both reduce the trim rate of the trim actuator 106 and command the display device 136 to display a visual alert message and generate an audible alert. By combining multiple actions into the first mitigation operation, the system is tolerant of faulty sensor data because slowing the trim rate of the trim actuator 106 can ensure that the obstruction sensors 123 continue to sense the obstruction as it is approached by the drive unit 102, as opposed to stopping trim of the drive unit 102 completely at the first detection of an obstruction. In addition, by combining multiple actions into the mitigation operation, the operator may be more likely to recognize and respond to the obstruction. The actions comprising the first mitigation operation may further depend on the trim angle of the drive unit 102 as sensed by the trim position sensor 124. For example, if the obstruction has been sensed on the transom by one of the transom-facing obstruction sensors 123, there may be more time to respond to the obstruction if the drive unit 102 is still within the running trim range as opposed to the trailer trim range, and accordingly, the first mitigation action performed at step 1012 may comprise slowing the trim rate of the trim actuator 106, rather than stopping it entirely.

At step 1014, the controller 116 determines whether the obstruction has been removed based on signals received from the obstruction sensor 123. In an exemplary embodiment, step 1014 may be performed at the expiration of a delay period (e.g., 1-30 seconds). If the obstruction sensor 123 indicates that the obstruction has been removed, method 1000 reverts to step 1002 to continue trimming the drive unit 102. If, however, the controller 116 determines that the obstruction has not been removed at step 1014, method 1000 proceeds to step 1016, in which the controller 116 performs a second impact mitigation operation to prevent the trimmable drive unit 102 from contacting the detected obstruction.

In various embodiments, the second mitigation operation of step 1016 may include one or more actions that are similar to the first mitigation operation performed at step 1012, although the actions comprising the second mitigation operation may be more severe or intrusive to the operator to indicate the sustained or enhanced risk of the drive unit 102 contacting the detected obstruction. For example, if the first mitigation operation at step 1012 includes reduction of the trim rate of the drive unit 102, the second mitigation operation of step 1016 may include the controller 116 commanding the trim actuator 106 to stop trimming the drive unit 102 completely. Similarly, if the first mitigation operation at step 1012 included visual and audible alert components, the second mitigation operation of step 1016 may include varying the characteristics of the pending impact alarms (e.g., displaying an alert featuring red as opposed to yellow or orange, increasing the frequency, pitch, or volume of an audible alert) to indicate the sustained or enhanced risk to the drive unit 102. As described above with reference to the first mitigation operation of step 1012, the second mitigation operation of step 1016 may comprise a combination of mitigation actions. For example, if the first mitigation operation of step 1012 includes reducing the trim rate of the drive unit 102 and displaying a yellow visual alert on the display device 136, the second mitigation operation of step 1016 may include stopping the trim actuator 106, displaying a red visual alert and/or emitting an audible alert from the display device 136.

At step 1018, the controller 116 again determines whether the obstruction has been removed based on signals received from the obstruction sensor 123 at the expiration of a delay period. If the obstruction sensor 123 indicates that the obstruction has been removed, method 1000 reverts to step 1002 to continue trimming the drive unit 102. However, if the obstruction sensor 123 indicates that the obstruction has not been removed, method 1000 terminates at step 1020, although the steps of method 1000 may be repeated upon a subsequent demand by the operator to increase the trim of the drive unit 102.

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A system configured for controlling a trim position of a trimmable drive unit with respect to a marine vessel, the system comprising:

a trim actuator coupled to the trimmable drive unit and configured to rotate the trimmable drive unit about a horizontal trim axis;

at least one obstruction sensor on the trimmable drive unit configured to sense obstructions proximate the trimmable drive unit, wherein the at least one obstruction sensor includes a front-facing sensor on a front side of an upper cowl of the trimmable drive unit and configured to sense the obstructions on the marine vessel that will be impacted by the upper cowl as the trimmable drive unit is rotated about the horizontal trim axis; and a controller operably coupled to the trim actuator and the at least one obstruction sensor, wherein the controller is configured to:

operate the trim actuator to rotate the trimmable drive unit about the horizontal trim axis;

while the trim actuator is being operated, receive a signal from the at least one obstruction sensor indicating an obstruction on the marine vessel that will be impacted by further rotating the trimmable drive unit about the horizontal trim axis; and perform a mitigation operation to prevent the trimmable drive unit from impacting the obstruction.

2. The system of claim 1, wherein the at least one obstruction sensor comprises at least one of an infrared sensor, an ultrasonic sensor, and an electromagnetic sensor.

3. The system of claim 1, wherein the mitigation operation comprises generating a pending impact alarm.

4. The system of claim 3, wherein the pending impact alarm comprises at least one of an audible alarm emitted by an audible alarm device and a visual alarm displayed on a display device.

5. The system of claim 1, wherein the mitigation operation comprises operating the trim actuator to stop rotating the trimmable drive unit.

6. The system of claim 1, wherein the mitigation operation comprises operating the trim actuator to reduce a trim rate of the trimmable drive unit.

7. The system of claim 1, wherein the at least one obstruction sensor further includes a rear-facing sensor on a cowl of the trimmable drive unit above a water surface and configured such that a field of view of the sensor moves with the trimmable drive unit to sense obstructions behind the trimmable drive unit that will be impacted as the trimmable drive unit rotates as about the horizontal trim axis.

8. The system of claim 1, wherein the mitigation operation comprises a first mitigation operation, and wherein the controller is further configured to:

after performing the first mitigation operation, receive a signal from the at least one obstruction sensor indicating the obstruction remains within a predetermined threshold distance of the trimmable drive unit; and perform a second mitigation operation to prevent the trimmable drive unit from impacting the obstruction.

9. The system of claim 8, wherein the first mitigation operation is not identical to the second mitigation operation.

10. The system of claim 1, wherein the mitigation operation is performed responsive to a determination that a thrust is not commanded from the trimmable drive unit.

11. A method of controlling trim position of a trimmable drive unit on a marine vessel, the method comprising:

receiving a prompt to perform a trim check;

receiving a signal from at least one obstruction sensor, wherein the at least one obstruction sensor includes a front-facing sensor on a front side of an upper cowl of the trimmable drive unit configured to sense the obstructions on the marine vessel that will be impacted by the upper cowl as the trimmable drive unit is rotated about a horizontal trim axis;

based on the signal, detecting an obstruction on the marine vessel that will be impacted by further rotating the trimmable drive unit about the horizontal trim axis; and responsive to a determination that a thrust is not commanded from the trimmable drive unit, performing a mitigation operation to prevent the trimmable drive unit from impacting the obstruction.

12. The method of claim 11, wherein the trimmable drive unit is an outboard motor.

13. The method of claim 11, wherein the at least one obstruction sensor comprises at least one of an infrared sensor, an ultrasonic sensor, and an electromagnetic sensor.

14. The method of claim 11, wherein the mitigation operation comprises generating a pending impact alarm.

15. The method of claim 14, wherein the pending impact alarm comprises at least one of an audible alarm emitted by an audible alarm device and a visual alarm displayed on a user interface.

16. The method of claim 11, wherein the mitigation operation comprises operating a trim actuator to stop rotating the trimmable drive unit.

17. The method of claim 11, wherein the mitigation operation comprises operating a trim actuator to reduce a trim rate of the trimmable drive unit.

18. The method of claim 11, wherein the at least one obstruction sensor further includes a rear-facing sensor on a cowl of the trimmable drive unit above a water surface and configured such that a field of view of the sensor moves with the trimmable drive unit to sense obstructions behind the trimmable drive unit that will be impacted as the trimmable drive unit rotates as about the horizontal trim axis.

19. The method of claim 11, wherein the prompt to perform the trim check is a key-up operation of the marine vessel.

20. The method of claim 11, wherein the prompt to perform the trim check is an operator request for a change in a trim angle of the trimmable drive unit.

21. The method of claim 11, wherein the prompt to perform the trim check is a signal from a gear state sensor indicating that a transmission of the trimmable drive unit has moved into a forward gear or a reverse gear.

* * * * *